United States Patent [19]

Yoshino

[11] 4,254,882

[45] Mar. 10, 1981

[54] PLASTIC PRESSURE BOTTLE

[75] Inventor: Yataro Yoshino, Tokyo, Japan

[73] Assignee: Yoshino Kogyosho Co., Ltd., Tokyo, Japan

[21] Appl. No.: 65,261

[22] Filed: Aug. 9, 1979

[30] Foreign Application Priority Data

Sep. 8, 1978 [JP] Japan ..... 53/123540

[51] Int. Cl.[3] ..... B65D 1/02

[52] U.S. Cl. ..... 215/1 C; 220/70

[58] Field of Search ..... 215/1 C; 220/70, 69

[56] References Cited

U.S. PATENT DOCUMENTS

| | | | |
|---|---|---|---|
| 2,750,769 | 6/1956 | Yost | 220/69 |
| 3,598,270 | 8/1971 | Adomaitis | 215/1 C |
| 3,727,783 | 4/1973 | Carmichael | 215/1 C |
| 3,935,955 | 2/1976 | Das | 215/1 C |

*Primary Examiner*—Donald F. Norton

*Attorney, Agent, or Firm*—Fidelman, Wolffe & Waldron

[57] ABSTRACT

A biaxially oriented molded bottle of a saturated polyester, especially polyethylene terephthalate, exhibits various superior characteristics as a bottle container but, because of its lack of mechanical strength, its use as a pressure bottle has been regarded as impossible. According to the invention, the lack of mechanical strength is compensated for by slightly increasing the wall thickness of the bottle, and providing a bottom structure having a plurality of legs designed to counteract the deformation caused by the internal pressure.

14 Claims, 8 Drawing Figures

PLASTIC PRESSURE BOTTLE

This invention relates to a biaxially oriented molded pressure bottle of a saturated polyester resin, especially polyethylene terephthalate.

Bottle containers for beer and carbonated beverages are now made of glass without exception. This is due for the most part to the conventional practice, but is presumably because glass bottles are easy to mold and relatively inexpensive, and have high resistance to internal pressure. The pressure glass bottles, however, have the defect that they are costly as compared with ordinary bottle containers and are weak to external impact, they will be broken to pieces and scattered in all directions in the event of an explosion accident, thus causing a serious danger, and that because the weight of the bottles is large for their size, much labor is required for transporting and handling them.

Moreover, since glass bottles cannot be disposed of by the consumers, a system of recovery and re-use of the used bottles must be established in almost all cases. This would entail a recovering operation, a rinsing operation, a sterilizing operation, and an inspecting operation to determine the reusability of the recovered bottles, and enormous amounts of expediture must go into the recovery and reuse of such bottles.

Because of many such defects of pressure bottles made of glass, it was suggested to produce pressure bottles from synthetic resins. But this has not yet been realized for one or more reasons. For example, since the synthetic resin is more flexible than glass, if the structure of a pressure glass bottle is merely copied, the bottle, especially its bottom, will be deformed upon the application of pressure. If a pressure bottle of synthetic resin is made in the same thickness as glass bottles, the cost of the material becomes much higher. As in the case of glass, plastic bottles cannot be disposed of by the consumer, for example by burning.

Furthermore, even if a pressure bottle can be produced from a synthetic resin material, it can be fully foreseen that it will be unstable because of its lighter weight than glass bottles.

The present invention was achieved in order to solve the aforesaid problems associated with the molding of pressure bottles from plastic materials. According to the present invention, a pressure bottle is made by blow molding of a saturated polyester resin, especially polyethylene terephthalate, which has resistance to bottle contents, and when burned, produces only a small amount of heat and does not generate toxic gases. The bottle is made fully resistant to internal pressure without requiring a large wall thickness by providing an odd number of legs at the bottom of the bottle.

It is an object of this invention therefore to provide a biaxially oriented molded pressure bottle of a saturated polyester resin, especially polyethylene terephthalate, which structurally exhibits high resistance to internal pressure without causing inconveniences such as the drastic decrease of the internal volume of the bottle and the reduced stability of standing of the bottle.

Another object of this invention is to improve the stability of standing of a bottle.

Other objects and advantages will become apparant from the following description taken in conjunction with the accompanying drawings in which.

The present invention is described specifically with reference to the accompanying drawings.

Figure 1:
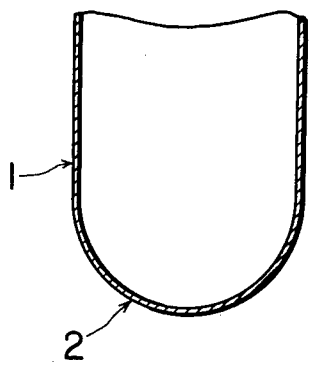
FIG. 1 is a longitudinal sectional view showing the most ideal bottom structure of a pressure bottle.

Since a pressure bottle has a high internal pressure, its bottom portion 2 is most ideally made semi-spherical as shown in FIG. 1.

In the embodiments shown in FIG. 1, the internal pressure of the bottle 1 exerted on the bottom portion 2 acts equally on the entire area of the bottom portion 2 in a radial direction. Accordingly, the internal pressure is not concentrated at a particular part of the bottom portion 2, and thus, a structure which can withstand internal pressure is provided.

Certainly, the structure of the bottom 2 shown in FIG. 1 exhibits ideal strength against internal pressure, but since such a bottle cannot stand by itself, legs must be separately molded and attached to the bottle.

Figure 2:
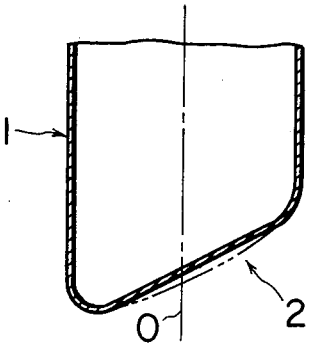
FIG. 2 is a longitudinal section view of a bottom structure which shows the basic concept of the present invention.

The present inventor modified the bottom portion 2 shown in FIG. 1, and tested internal pressure resistance with a bottom portion having a rounded protrusion at the desired circumferential end portion as shown in FIG. 2, namely the bottom portion 2 having the configuration resulting from the deviation of the lower end position of the bottom 2 shown in FIG. 1 from the center of the bottle. As a result, the present inventor ascertained that as shown by the two-dot chain line in FIG. 2, the central portion is slightly pushed outwardly (downwardly), and the bottle exhibits sufficiently high resistance to internal pressure.

The present invention has been achieved by utilizing the basic structure shown in FIG. 2, and relates to a biaxially oriented molded pressure bottle made by using a saturated polyester resin, particularly polyethylene terephthalate, which exhibits superior resistance to chemical contents, to impact and to permeation. Additionally, the bottle has sufficient mechanical hardness and can be burned with a low amount of heat generation without producing toxic gases.

The bottom structure of the bottle in accordance with the invention has a plurality of adjacent legs, each of said legs formed by a generally trigonal pyramidal shaped protrusion having an apex positioned below an open base, two inclined side surfaces 5, 5 and a portion of said outer wall, said side surfaces 5, 5 intersecting at an edge line 6 radially extending from a center point 0 on the vertical axis of the bottle to said apex, and each of said inclined side surfaces 5, 5 of each leg being attached to an inclined side surface of an adjacent leg to form valley lines 7 of intersection. The bottom structure is equally divided by the valley lines 7 into an odd number of sections at equal central angles. Each of the sections forms a leg which, in alternate description, is constructed such that two inclined side surfaces 5, 5 in the form of a triangle having valley lines 7, 7 as a base form an edge line 6 resulting from the extension of valley lines 7 opposing each other with respect to the center point 0 in this section, and the edge line 6 is cut off at its end to form a tip in the shape of a truncated trigonal pyramid having a flat bottom surface 4 thus forming a leg 3. In other words, as is clearly seen from FIG. 5 which shows an embodiment in which five valley lines 7 are provided, five legs 3 in the shape of a truncated trigonal pyramid opposing the respective valley lines 7 are arranged at equal intervals.

Figure 5:
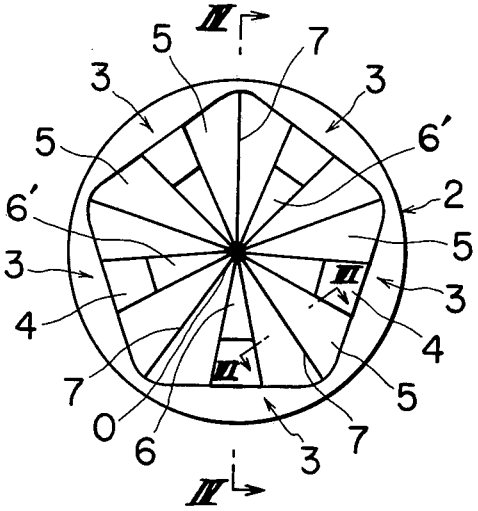
FIG. 5 is a bottom view of a bottle.
Figure 4:
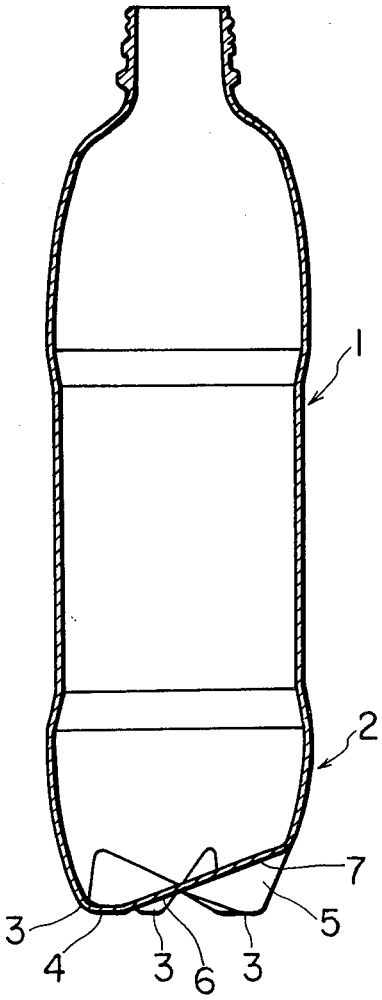
FIG. 4 is a longitudinal sectional view taken along the line IV—IV of FIG. 5.

As is clearly seen from the longitudinal section shown in FIG. 4 which is taken along the line IV—IV of FIG. 5, a valley line 7 and a leg 3 opposite thereto have the same structure as in the basic construction shown in FIG. 2. Thus, the internal pressure of bottle 1 acts to push the portion from the valley line 7 to the edge line 6 outwardly (downwardly). As a result of various experiments conducted in regard to FIG. 2, it has been ascertained that this structure exhibits sufficient durability to the internal pressure of the bottle.

Figure 6:
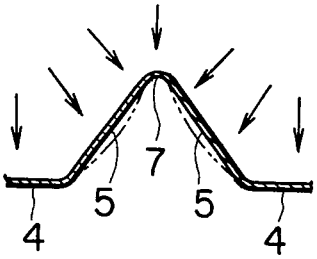
FIG. 6 is an enlarged sectional view of the principal parts taken along the line VI–VI of FIG. 5.
Figure 3:
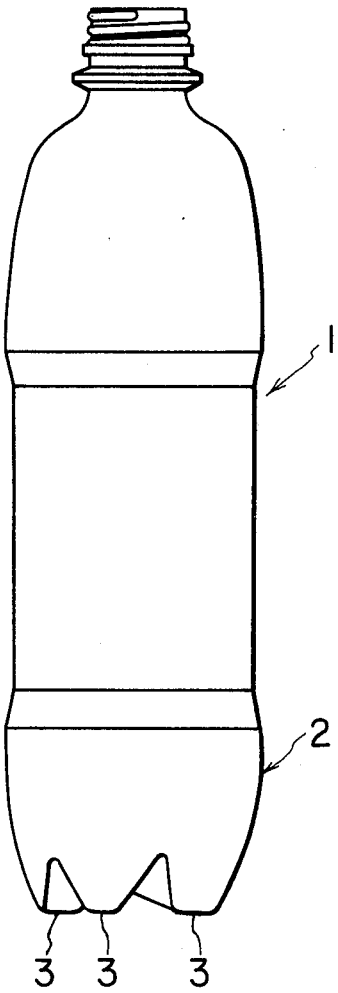
FIG. 3 is a front elevation of a bottle having the bottom structure in accordance with this invention.

As is clear from FIG. 6 which shows the enlarged sectional view of the portion of the valley line 7, when the internal pressure acts on the valley line 7, the inclined side surfaces 5, 5 having the valley line 7 as a base are deformed in a manner to curve and protrude slightly outwardly as shown by the two-dot chain line in FIG. 6.

This deformation of the inclined side surfaces 5 results in the slight downward displacement of the valley line 7. However, the amount of the downward displacement of the valley line 7 is only slight because this downward displacement generates at the portion of the valley line 7 the pulling force to inhibit this downward displacement and the curved inclined side surfaces 5 take the form which is conducive to the inhibition of the downward displacement of the valley line 7.

Taking up the leg 3 at the portion of the edge line 6, the inclined side surfaces 5, 5 and the valley line portion 7 at the leg 3 bulge outwardly by the action of the internal pressure, and simultaneously are displaced downwardly. However, since the downward displacement of the valley line 7 is hampered because of its structure, a pulling force is exerted on the surfaces 5 and the edge line 6 from the valley lines 7 on the both sides via the two inclined side surfaces 5, or directly from the opposing valley lines 7. By this pulling force, the expanding deformation of the bottle by the action of internal pressure is inhibited when it occurs to a slight degree.

The bottom 2 of the bottle in accordance with this invention firmly retains its stable form against the internal pressure of bottle 1 by the dynamically effective supporting of the individual legs 3 by the individual valley lines 7.

The bottom surface 4 of the leg 3 is not necessarily limited to a flat surface as shown in the drawings, and may be of a structure protruding in an arcuate form. However, since the bottom surface 4 always undergoes external impact during the handling of the bottle 1, it is desirably a flat surface in order to increase its impact strength.

Similarly, the edge line 6 should preferably be made a ridge surface 6′ in the form of an elongated triangular plane having one side of the bottom surface 4 as a base and the center point 0 as an apex as shown in FIG. 5 rather than a mere line. This is for the purpose of preventing the internal pressure of the bottle exerted on the legs 3 from being concentrated on the edge line 6. By making the edge line 6 a planar structure, the leg 3 can be deformed into a form close to a more smooth curved structure at the time of the application of internal pressure.

In particular, the ridge surface 6′ is formed by truncating a generally trigonal pyramidal shaped protrusion having an apex positioned below an open base, two inclined side surfaces 7, 7 and a portion of the outer wall of the bottle, along the intersection of said side surfaces and a third surface radially extending through the center point on the vertical axis of the bottle to form the ridge surface 6′ and a tip at the intersection of said third surface with the outer wall. Each of said inclined side surfaces 5, 5 of each leg is attached to an inclined side surface of an adjacent leg to form a valley line 7 of intersection.

Needless to say, each line 8 intersection including the valley lines 7 forming the bottom portion 2 is formed by a curved surface having a relatively large radius of curvature and not by a creased structure.

The embodiment shown in the drawings includes five valley lines 7 and thus five legs 3. The number of legs may be 3 or 7, and in short, any odd number considered to be suitable.

Since the bottle 1 of this invention is only slightly larger in wall thickness than ordinary biaxially stretched blow-molded bottles, the weight of the entire bottle is much lower than that of a conventional pressure glass bottle having the same internal capacity.

Since the bottle 1 is molded from a saturated polyester resin, desirably polyethylene terephthalate, the surface of the molded bottle 1 is extremely smooth.

Naturally, the bottom surface 4 is also a very smooth surface. When the bottom surface 4 is too smooth, it may have the inconvenience of too great a tendency to slip.

Figure 7:
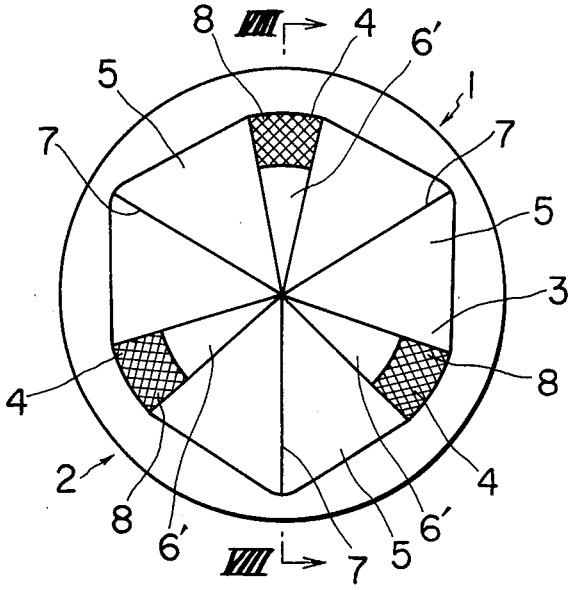
FIG. 7 is an enlarged bottom view of an embodiment in which the bottom surface has a slip-preventing means.
Figure 8:
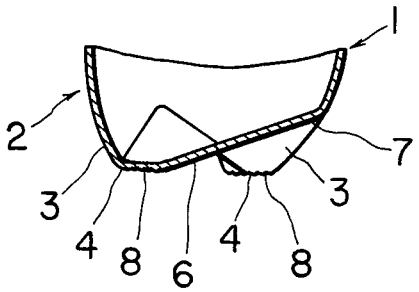
FIG. 8 is a longitudinal sectional view of the diminished principal parts taken along the line VIII—VIII of FIG. 7.

In order to prevent slippage of the bottle 1 on a flat surface, the embodiment shown in FIGS. 7 and 8 includes a number of slender protrusions and depressions 8 on the bottom surface 4.

The frictional resistance of the bottle 1 against a surface, for example a floor surface, on which to place the bottle 1 is increased by these many slender protrusions and depressions 8. This prevents the slippage of the bottle in its erect posture, or its tumbling.

The bottle of this invention exhibits a number of excellent advantages. For example, since the bottle 1 of this invention is made of a saturated polyester resin, especially polyethylene terephthalate resin, the consumers can freely dispose of it by burning. The bottom structure can exhibit very strong durability to internal pressure with good stability in terms of its structure. Furthermore, since the legs 3 are formed at equal intervals at the circumferential edge of the bottom structure, the bottle 1 can be stably kept in its erect posture. The body of the bottle, which may be of a simple cylindrical shape, is inherently resistant to pressures, and the amount of the plastic material required to mold the entire bottle 1 can be small. Thus, the bottle can be manufactured at low cost and in light weight. Since the frictional resistance of the bottom portion against a floor surface on which the bottle is to be placed erect can be made high, a stable erect posture can be maintained.

What is claimed is:

1. A biaxially oriented, blow-molded pressure bottle of a saturated polyester resin having a vertical axis, an outer wall, a bottom structure and a center point of intersection of said bottom structure with said vertical axis, said bottom structure comprising: an odd-numbered plurality of adjacent legs, each of said legs formed by truncating a generally trigonal, pyramidal shaped protrusion having an apex positioned below an open base, two inclined side surfaces and a portion of said outer wall, along the intersection of said side surfaces and a third surface radially extending through said center point to form a ridge surface and a tip at the intersection of said third surface with said outer wall, and each of said inclined side surfaces of each leg being attached to an inclined side surface of an adjacent leg to form a valley line of intersection.

2. A bottle as in claim 1, wherein said tip is truncated to form a bottom surface.

3. A bottle as in claim 2, wherein said bottom surface is flat.

4. A bottle as in claim 2, wherein said bottom surface is arcuate.

5. A bottle as in claim 2, wherein said bottom surface is a non-skid surface.

6. A bottle as in claim 1, wherein said legs are equal in size and whereby said valley lines, when extended through said center point, lie on the ridge surface of another leg.

7. A bottle as in claim 1, wherein said polyester resin is polyethylene terephthalate.

8. A biaxially oriented, blow-molded pressure bottle of a saturated polyester resin having a vertical axis, an outer wall, a bottom structure and a center point of intersection of said bottom structure with said vertical axis, said bottom structure comprising: an odd-numbered plurality of adjacent legs, each of said legs formed by a generally trigonal, pyramidal shaped protrusion having an apex positioned below an open base, two inclined side surfaces and a portion of said outer wall, said side surfaces intersecting at an edge line radially extending from said center point to said apex, and each of said inclined side surfaces of each leg being attached to an inclined side surface of an adjacent leg to form a valley line of intersection.

9. A bottle as in claim 8, wherein said apex is truncated to form a bottom surface.

10. A bottle as in claim 9, wherein said bottom surface is flat.

11. A bottle as in claim 9, wherein said bottom surface is arcuate.

12. A bottle as in claim 9, wherein said bottom surface is non-skid surface.

13. A bottle as in claim 8, wherein said legs are equal in size and whereby said valley lines, when extended through said center point, lie in the edge line of another leg.

14. A bottle as in claim 8, wherein said polyester resin is polyethylene terephthalate.

* * * * *